US006564732B1

(12) United States Patent
Hosagasi et al.

(10) Patent No.: US 6,564,732 B1
(45) Date of Patent: May 20, 2003

(54) ACTUATING DEVICE FOR MATERIAL PRESSING DEVICE OF SEWING MACHINE OR SEWING MEANS

(75) Inventors: Sevki Hosagasi, Kaiserslautern (DE); Helmet Jung, Kaiserslautern (DE); Michael Kilian, Reinheim (DE)

(73) Assignee: Quick-Rotan Elektromotoren GmbH, Kaiserslautern (DE)

( * ) Notice: Subject to any disclaimer, the term of this patent is extended or adjusted under 35 U.S.C. 154(b) by 0 days.

(21) Appl. No.: 09/787,742

(22) PCT Filed: Sep. 22, 1999

(86) PCT No.: PCT/EP99/07061

§ 371 (c)(1),
(2), (4) Date: Jul. 5, 2001

(87) PCT Pub. No.: WO00/18997

PCT Pub. Date: Apr. 6, 2000

(30) Foreign Application Priority Data

Sep. 26, 1998 (DE) ..... 198 44 201

(51) Int. Cl.[7] ..... D05B 29/02; D05B 69/28
(52) U.S. Cl. ..... 112/239; 310/154.06
(58) Field of Search ..... 112/239; 310/154.06

(56) References Cited

U.S. PATENT DOCUMENTS 1,383,438 A * 7/1921 Stein ..... 112/239
4,214,540 A 7/1980 Cook
4,347,442 A * 8/1982 White et al. ..... 290/48
4,538,533 A 9/1985 Ohchi
4,587,911 A * 5/1986 Kinoshita ..... 112/239
4,716,846 A * 1/1988 Schneider et al. ..... 112/239
5,551,361 A 9/1996 Clapp

FOREIGN PATENT DOCUMENTS

DE 3217826 12/1982
DE 8807493 7/1988

* cited by examiner

*Primary Examiner*—John J. Calvert
*Assistant Examiner*—Robert H. Muromoto, Jr.
(74) *Attorney, Agent, or Firm*—Antonelli, Terry, Stout & Kraus, LLP

(57) ABSTRACT

An actuating device intended for a sewing device or sewing machine includes a material pressing device for holding down the material to be sewn during stitch formation and transport, and at least one linear motor which serves as regulating element for the material pressing device. The drive rod of the actuating element is connected to the material pressing device so as to control the pressure the pressing device exerts on the material to be sewn. The drive rod is linked to the pressing device via at least one elastic low-mass coupling element and the pressing device can be placed by the linear motor back and forth between a raised and a lowered position.

26 Claims, 5 Drawing Sheets

ACTUATING DEVICE FOR MATERIAL PRESSING DEVICE OF SEWING MACHINE OR SEWING MEANS

BACKGROUND OF THE INVENTION

This invention relates to an actuation device intended for a sewing means or sewing machine, having a presser means for holding down the sewn material during stitching and material transport, as the actuating element for the presser means at least one linear motor with a drive rod for controlling the presser force which is applied by the presser means to the material, which rod is connected to the presser means.

The presser means of a sewing machine (hereinafter the expression "sewing machine" also comprises sewing means, this invention relating both to sewing means and also to sewing machines) is used to fix the position of the sewn material during needle puncture and to apply a pressing force to the material in the transport phase by which the transport means can push the sewn material onward.

In the past, in this connection efforts were made to produce the pressing force applied by the presser means using electromagnets. Since as the sewing speed becomes greater the presser force necessary for perfect interaction with the transport means is very high, attempts in this respect with electromagnets have failed among others due to the nonlinear behavior of electromagnets with respect to current flow and force in conjunction with the respective position.

One alternative approach is described in U.S. Pat. No. 4,214,540. According to this document a spring presses on the presser foot via a lever, the lever being supported in the middle. A linear motor engages the bearing point so that by shifting the bearing point the lever ratios change and thus the force on the presser foot is adjusted.

In this principle which is presented in U.S. Pat. No. 4,214,540 however it has been especially problematical that the high force of the presser foot is indirectly adjusted by a relatively weak linear motor. The technical implementation in this respect is not only complicated, but also costly since very high positioning accuracy of the linear drive is necessary.

U.S. Pat. No. 5,551,361 discloses a sewing machine in which the presser means is designed to apply to the sewn material a constant pressing force which is not influenced by the force acting on the feed dog. For this purpose the pressure bar is connected to a force sensor which is used to determine the current presser force. These measurement signals are converted into control signals for a linear motor which is attached to the sewing machine housing, the pressure bar moreover forming the drive rod of the linear motor.

Aside from the fact that in this presser means the control engineering complexity is considerable, there is another major disadvantage that the pressure bar is directly connected to the drive rod of the linear motor and the two rods form a common component. Since this rod additionally bears another coil or the movable parts of the linear motor, the mass to be moved is very great overall. To control the corresponding forces of mass inertia therefore the linear motor especially at high rpm of the sewing machine must apply very high forces so that the presser foot does not rise off the feed dog. The high forces to be applied in turn cause strong vibrations of the sewing machine.

SUMMARY OF THE INVENTION

Proceeding from the above described defects and deficiencies the object of this invention is to make a generic actuation means such that the force is transferred to the presser means in a direct, mechanically simple and still exact manner.

This object is achieved by an actuation means intended for a sewing means or sewing machine in which the drive rod with the presser means is connected via at least one elastic, low-mass coupling element and in which the presser means can be moved by the linear motor between the raised position and the lowered position.

Since the actuation device as the actuating element for the presser means has at least one linear motor with a drive rod for controlling the presser force which is applied by the presser means to the material, which rod is connected to the presser means, the force is transferred to the presser means in a direct, mechanically simple and still exact manner. Since the action of the force in the linear motor depends on the direction of current flow, the presser means is raised in one direction of current flow and pressed down in the other direction of current flow so that the presser means according to the teaching of this invention can be moved by the linear motor between a raised position and a lowered position.

For this reason the linear motor is suited as the direct actuating element for the presser means in an especially convincing manner; this differs from the approach which was common in the past, specifically producing the pressing force by pretensioning of a spring, in that the latter technically conventional approach to lifting the presser means requires an additional actuating element, for example an electromagnet. In contrast, the linear motor in this invention is used not only for producing the presser force, but is also used for lifting and lowering the presser means.

According to the teaching of the invention, on the other hand, the drive rod is connected to the presser means via at least one elastic, low-mass coupling element. In this way the drive rod of the linear motor is decoupled from the presser means so that the masses to be moved are kept small.

In this connection, keeping the moving masses small in a presser means is known. Thus for example DE-A-32 17 826 discloses a hollow pressure bar in which a correspondingly formed shaft of the presser foot is movably held. A spring which is supported for its part on an adjustable rod and which is located in the pressure bar presses on the shaft. The shaft of the presser foot is held by means of a holding plate in a somewhat larger slot of the hollow pressure bar, enabling limited vertical pushing motion of the presser foot relative to the hollow pressure bar. A second stronger spring exerts an adjustable pressure force on the hollow pressure bar via a guide part which is attached to the hollow pressure bar, the spring path of the pressure bar being limited by a collar which is attached to it and which is supported on a fixed guide bush.

This construction for reduction of moving masses is tailored to a presser means with two springs and due to measures for limitation of the spring path is unsuited to the presser means as claimed in the invention with only one elastic, freely movable coupling element. This construction could not therefore encourage one skilled in the art to develop the actuation device as claimed in the invention.

DETAILED DESCRIPTION OF THE PREFERRED EMBODIMENTS

Figure 1:
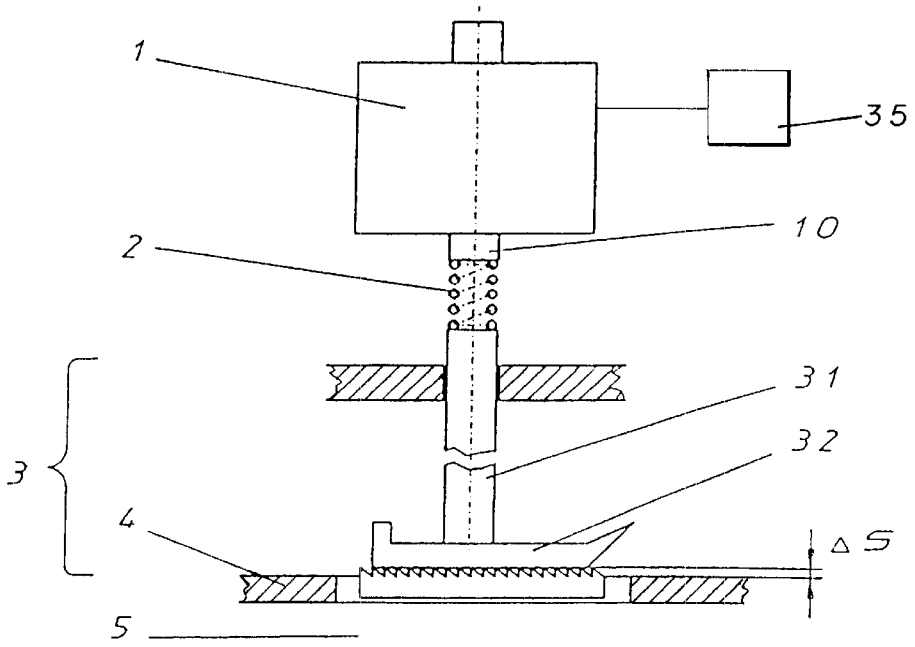
FIG. 1 shows a first embodiment of an actuation device as claimed in the invention.

According to preferred embodiments which can be executed independently of one another and in conjunction with one another, it is provided that

- the coupling element is a helical spring; and/or
- the drive rod is located over the presser means; and/or
- the coupling element is a leaf spring; and/or
- the drive rod is arranged laterally offset to the presser means; and/or
- the presser means has a pressure bar and a presser foot; and/or
- the linear motor is made such that the presser means is held in the upper position at an almost disappearing current flow; and/or
- the presser means can be switched by program control or pushbutton control without force; and/or
- the linear motor is essentially ironless; and/or
- the linear motor has at least two permanent magnets; and/or
- the permanent magnets are rectangular or annular; and/or the material of the permanent magnets is based on iron, neodymium and boron; and/or
- magnet closing within the linear motor takes place via the housing, via a middle piece and via an air gap with a coil; and/or
- the annular permanent magnets are spaced apart from one another and the magnetization of the one annular permanent magnet is directed against the magnetization of the other annular permanent magnet; and/or
- the location of the annular permanent magnets in the housing of the linear motor is dictated by spacer rings; and/or
- the coil is divided into at least two component coils which are wound in opposite directions; and/or
- the drive rod is guided via at least two bearing bushes in the middle piece; and/or
- the middle piece has an opening in which an iron piece or a pin formed as a slide block is guided; and/or
- the iron piece or the pin is connected to the drive rod; and/or
- the opening is located centrally in the middle piece; and/or
- the opening and/or the iron piece is/are made rectangular; and/or
- on one end of the iron piece there is a projecting part of ferromagnetic material which produces a magnetic attraction force; and/or
- the projecting part is made of steel; and/or
- the iron piece for transfer of the drive force to the drive rod is connected to the coil via a coil brace; and/or
- the opening is made as an elongated hole and the pin is made round; and/or
- the pin is made of steel; and/or
- the drive rod is pretensioned by at least one spring element; and/or
- there are at least two spring elements; and/or
- the spring elements are located on both sides of the middle piece; and/or
- the linear motor in the de-energized state presses the presser means by means of at least one spring element with a force against the needle plate of the sewing means or the sewing machine which is roughly one third of the maximum force of the presser means; and/or
- the direction and/or the strength of the current flow in the linear motor can be controlled by at least one microprocessor; and/or
- the motion of the presser means takes place time-controlled by the linear motor; and/or
- shortly before reaching the raised position or shortly before reaching the lowered position there is one reversal of the flow direction in the linear motor at a time; and/or
- the force of the linear motor can be controlled by means of the angular position of the main shaft of the sewing means or sewing machine; and/or
- the linear motor in the transport phase of the feed dog applies a force which counteracts the force acting on the drive rod via the coupling element; and/or
- the force of the linear motor and the force acting on the drive rod via the coupling element are quantitatively roughly the same; and/or
- the current flow in the linear motor outside of the transport phase of the feed dog is reduced; and/or
- the coupling element at high rpm of the sewing means or sewing machine has increased pretensioning; and/or
- the current flow in the linear motor at high rpm of the sewing means or sewing machine has a direct current component; and/or
- the direct current component of the current flow can be changed depending on the time and/or depending on the rpm of the sewing means or sewing machine; and/or
- the functional dependency of the current flow on the rpm of the sewing means or sewing machine after being determined for the first time can be stored in the sewing means or the sewing machine; and/or
- the starting point of current flow at high rpm of the sewing means or sewing machine can be advanced by an angular amount; and/or
- the starting point of the current flow can be advanced depending of the rpm of the sewing means or sewing machine; and/or
- the presser means is switched without force when the first stitch is formed.

In particular, the following will be explained regarding the preferred embodiments which can be provided independently of one another or in conjunction with one another:

The coupling element according to the teaching of this invention is advantageously a helical spring. In this way, on the one hand the drive rod of the linear motor is decoupled from the presser means, on the other hand however the desired direct connection between the drive rod of the linear motor and the presser means is ensured.

According to one preferred embodiment of this invention, the drive rod is located over the presser means. In this embodiment force is transferred from the drive rod of the linear motor to the presser means in a mechanically especially simple and yet precise manner.

Alternatively to the above described embodiment with a helical spring the coupling element can also be made in the form of a leaf spring. One such embodiment is especially feasible here when the drive rod, for example for reasons of construction, is feasibly located laterally offset to the presser means.

The presser means which can be switched without force by program control or pushbutton control preferably has a pressure bar and a presser foot.

The linear motor according to one advantageous embodiment of this invention is made such that the presser means is held in the top position at an almost disappearing current flow.

According to one preferred development of this invention the linear motor is essentially ironless. This then has the minor advantage that no additional magnetic forces act on the movable parts of the linear motor, as is undesirably the case in linear motors with iron parts.

In practice the linear motor has at least two preferably annular permanent magnets with which the magnetic field is produced.

The material of the permanent magnets can be based here on iron, neodymium, and boron, since with these magnetic materials very high energy densities can be achieved under economical conditions. With these very high energy densities the force necessary for the presser means can be easily directly produced.

The linear motor feasibly has among others a housing, a middle piece and an air gap with a coil. Accordingly, the magnetic circuit within the linear motor can in practice be closed via the housing, via the middle piece and via the air gap with the coil.

According to one especially preferred embodiment of this invention, the annular permanent magnets are spaced apart, the magnetization of one annular permanent magnet being advantageously directed against the magnetization of the other annular permanent magnet and/or the location of the annular permanent magnet in the housing of the linear motor being dictated preferably by spacer rings.

In this case the coil can feasibly be divided into at least two component coils which are wound in opposite directions, the total inductance of the coil due to this type of winding being much less than the inductance of the component coil so that a small electrical time constant of the linear motor is ensured; in this way angularly synchronous triggering of the motor force is possible and the linear motor can be controlled very quickly.

In the coil which is accordingly divided preferably in two chambers a force is produced as soon as electrical current flows through the coil. This force is proportional to the current intensity and independent of the location of the coil as long as the coil is located in the homogenous part of the magnetic field; the direction of the force is of course dependent on the direction of the current flow, and the direction and/or the intensity of the current flow in the linear motor can be controlled as recommended by a least one microprocessor.

Regardless thereof or in conjunction therewith, the motion of the presser means can take place time-controlled by the linear motor.

According to one preferred development of this invention the drive rod is guided via at least two bearing bushes in the middle piece.

The middle piece can have a preferably central opening in which an iron piece which is made as a sliding block is guided and which is advantageously connected to the drive rod. In this case the opening and/or the iron piece is/are made optionally rectangular. The purpose of this iron piece is to protect the drive rod against torsion on the one hand; on the other hand the drive force of the coil will be transferred via the iron piece to the drive rod.

According to one advantageous embodiment of this invention on one end of the iron piece there is a projecting part which produces a magnetic attraction force, made of ferromagnetic material, preferably steel. As already explained above by way of suggestion, this iron piece can be connected to the coil via a coil brace for transmission of the drive force to the drive rod.

In a development which is important to the invention and which is alternative to the iron piece made as the sliding block, the middle piece can have a preferably central opening in which a preferably steel pin is guided which is advantageously connected to the drive rod. Here the opening is optionally made as an elongated hole and the pin is optionally made round. The purpose of this pin is to protect the drive rod against torsion, on the one hand; on the other hand the drive force of the coil will be transferred via the pin to the drive rod.

The aforementioned properties and features are convincingly suitable for a presser drive, since in this way the presser force can be adjusted depending on the rpm of the sewing machine. The required pressing force for the presser means is however relatively high so that a direct drive, as in this invention, would dictate greater dimensions of the linear motor. But in order to ensure a compact execution of the linear motor, the drive rod according to one especially inventive development of the actuation device is pretensioned by at least one spring element.

If according to one feasible embodiment of this invention there are at least two spring elements, these spring elements are preferably located on both sides of the middle piece in order to reliably prevent generation of an additional moment.

Here the linear motor in the de-energized state should press the presser means by means of at least one spring element with a force against the needle plate of the sewing machine and against a feed dog which projects in the transport phase with its teeth over the top of the needle plate, which force is preferably roughly one third of the maximum force of the presser means. At slow sewing speeds sewing takes place with this pressing force of at least one spring element, and this pressing force can be reduced if necessary by a corresponding current being sent in the negative direction through the linear motor.

The preferred modes of operation and the desired functions of the actuating device as claimed in the invention are described below, thus as they prove useful by the above described advantageous embodiments:

Preferably the current flow through the linear motor in the negative direction can be dimensioned such that the force of at least one spring element is compensated and the presser force moreover disappears. This forceless switching of the presser means is important for sewing technology especially when the seam runs at a right angle.

In the corner point of the seam the sewing machine stops in the position in which the needle is at the bottom. The presser means is then feasibly switched without force so that the sewn material can be comfortably turned into the desired direction. As already indicated above, this forceless switching of the presser means can take place either program-controlled or pushbutton-controlled.

To ensure problem-free transport of the sewn material in sewing machines with elliptically driven feed dogs even at higher rpm of the sewing machine, the pressing force exerted by the presser means can be increased. As the sewing speed becomes greater the transport time accordingly becomes shorter. Since the transport path is constant, the acting accelerations do not increase proportionally at higher rpm of the sewing machine.

In the aforementioned transport means horizontal and vertical accelerations occur. As a result of the vertical accelerations there is the danger that the presser means will be lifted off the sewn material and accordingly transport will be adversely affected. For this reason, in conventional sewing machines known from the prior art the presser force is produced by a strong spring so that a spring-mass system with low friction is present, the mass of this vibratory system being determined by the equivalent mass of the spring and by the actual mass of the presser means.

Here attempts to increase the natural frequency of this spring-mass system led to a very strong spring which however at low sewing speeds makes itself deleteriously noticeable.

Fortunately, in the use of the linear motor as claimed in the invention as a force-generating element this spring can be omitted. With direct coupling of the linear motor to the presser means however other problems can arise, since in this case the vertical motion of the transport means would accelerate the presser means with the movable parts of the linear motor upward.

To brake this motion and to produce the force on the sewn material in a fraction of the transport phase the linear motor would have to produce much more force than the spring in the conventional systems known from the prior art. For this reason the drive rod is connected to the presser means via at least one elastic coupling element. The masses to be moved can be kept small by the drive rod of the linear motor being decoupled from the presser means by the elastic coupling element. In doing so the drive rod of the linear motor presses the presser foot via the coupling element against the needle plate.

The presser means moves up at the start of the transport phase. This motion presses the coupling element together so that the force increases according to the hardness of the coupling element. The drive rod of the linear motor would be accelerated by this force difference. But since the mass of the moving parts of the linear motor is relatively large compared to the pressure bar and moreover there is a certain friction, it can be assumed that the drive rod of the linear motor does not move out of its rest position at higher rpm of the sewing machine.

Since the moving parts of the linear motor in contrast to the armature of a conventional electromagnet are preferably of low mass, relatively low force of the linear motor is enough to move the presser means into the initial position within a short time. The weaker the coupling element is designed to be, the better the decoupling of the drive rod of the linear motor from the presser means. But this causes a longer path of the drive rod when the presser force is applied, for which reason the hardness of the coupling element can be adapted to the respective application from case to case.

When the presser means is raised, the linear motor must overcome the pretensioning force of the optional, at least one spring element, by which the drive rod is pretensioned. In the upward motion of the presser means this at least one spring element is tensioned so that the pretensioning force becomes greater with the stroke of the presser means.

When the presser means has reached its upper position and is to be held in this top position for some time, the linear motor must apply at least a force equivalent to the spring force. To do this, first with the maximum current the presser means is raised and then the current is lowered so far that the presser means is held in its upper position.

In the embodiment described above in which instead of a pin there is an iron piece made as a sliding block, this holding current can be greatly reduced by there being the above described self-holding mechanism at the top point in the form of a projecting part which is made of ferromagnetic material and which produces a magnetic attraction force.

When the presser means is lowered, this projecting force produces no action. But when the presser means approaches its top end position, the projecting part moves in the action area of the permanent magnet. Some of the magnetic field lines then run over the projecting part so that an attraction force is formed in the direction of the permanent magnet; moreover the direction of this attraction force is in the opposite direction to the force of the pretensioning by the spring elements. The magnitude of the attraction force depends on the mechanical structure.

The maximum attraction force occurs when the projecting part which produces the magnetic attraction force is in the uppermost position of the presser means on the edge of the homogenous magnetic field. The dimensioning of this unit should be chosen such that the magnetic attraction force and the force of the pretensioning by the spring elements almost cancel one another.

If at this point the presser means is generally to be lowered, the linear motor is supplied with the maximum current such that the drive rod of the linear motor experiences a direction of force downward.

After a small distance the magnetic attraction force disappears and the drive rod is accelerated dramatically down under the action of the force of the linear motor and the force of pretensioning. This would lead to undesirably strong impact of the presser foot against the needle plate.

In order to prevent this impact and associated with it to reduce the noise, shortly before reaching the raised position or shortly before reaching the lowered position there is reversal of the current direction in the linear motor, i.e. the current flow of the linear motor can be switched time-controlled shortly before reaching the lower position for a certain time into the opposite direction and thus the presser means can be braked. The instant of reversal of the direction of current flow and the duration of the braking phase should be adapted here to the mechanical circumstances.

The essentially identical approach can be used in an analogous manner also when the presser means is raised in order to enable soft impact against the raised position.

To prevent vibrations in the lower rpm range of the sewing machine and to achieve a constant actual stitch length in the middle rpm range of the sewing machine, the force of the linear motor according to one especially inventive development of this actuation device can be controlled by means of the angular position of the main shaft of the sewing machine.

Here the force of the linear motor can be controlled with the angle of the main shaft of the sewing machine for example such that the linear motor in the transport phase of the feed dog, in which the feed dog projects with its teeth over the top of the needle plate, applies a force which counteracts the force acting via the coupling element on the drive rod.

If for example the feed dog presses the presser foot up by a certain distance, the path change via the coupling element with the spring constant produces a force acting on the drive rod. When the force of the linear motor and the force acting on the drive rod via the coupling element are preferably quantitatively roughly the same, the drive rod remains in its rest position.

Outside of the transport phase of the feed dog the current flow in the linear motor is preferably reduced, by which at the same time the heating of the coil or component coils is kept low.

In order to prevent a change of the actual stitch length at high rpm of the sewing machine, the coupling element at high rpm of the sewing machine according to one inventive development of this actuation device has increased pretensioning. This can be accomplished for example by the current flow in the linear motor at high rpm of the sewing machine having a DC component, by which a constant force component of the linear motor is effected.

In one advantageous embodiment, the DC component of the current flow can be changed depending on the time and/or depending on the rpm of the sewing machine. Thus the force component increases feasibly with the rpm, the dependency of the current change on the rpm being determined by the structure of the sewing machine; for this reason, the functional dependency of the current flow on the rpm of the sewing machine can be stored in the sewing machine after being determined for the first time.

In order to eliminate the effect of the electrical time constant of the linear motor at high rpm of the sewing machine, the time at which the current flow is turned on at high rpm of the sewing machine can preferably be shifted forward by an angular amount, feasibly depending on the rpm of the sewing machine. This ensures that the linear motor at the start of motion of the presser means, especially of the presser foot, can reach the required counterforce.

The above explained possibilities for changing the force of the linear motor as a function of the angular position of the main shaft of the sewing machine or also depending on time can be used to perform the so-called wiper function, also with a linear motor-driven presser means. At the start of sewing the free end of the needle thread must lie exposed. Only then can the thread end during loop formation be pulled into the sewn material and thus later is no longer visible from above.

To do this, the start of the thread after cutting is conventionally placed by the wiper means in the direction of the operator on the presser means. If instead the end of the thread were clamped by the presser means, the amount of thread necessary for loop formation would be withdrawn from the thread storage so that the clamped thread end remains visible.

This defect can be avoided using the linear motor as claimed in the invention without the need for an expensive wiper means. To do this, the presser means, especially the presser foot, according to one inventive development of this actuation device is switched without force during the initial stitch formation, for example by the force of at least one spring element being compensated with the force of the linear motor. If at this point at the start of sewing the end of the needle thread is under the presser means, the end of the needle thread is no longer held by the presser means and can accordingly be pulled down in the initial stitch formation exactly as if it would lie on the presser means. After the first stitch formation the linear motor is then preferably switched into the normal sewing area.

Other embodiments, features and advantages of this invention are detailed below in the drawing using FIGS. 1 to 8 by which the embodiments of the actuation device as claimed in the invention which are different in exemplary form are illustrated.

Figure 5:
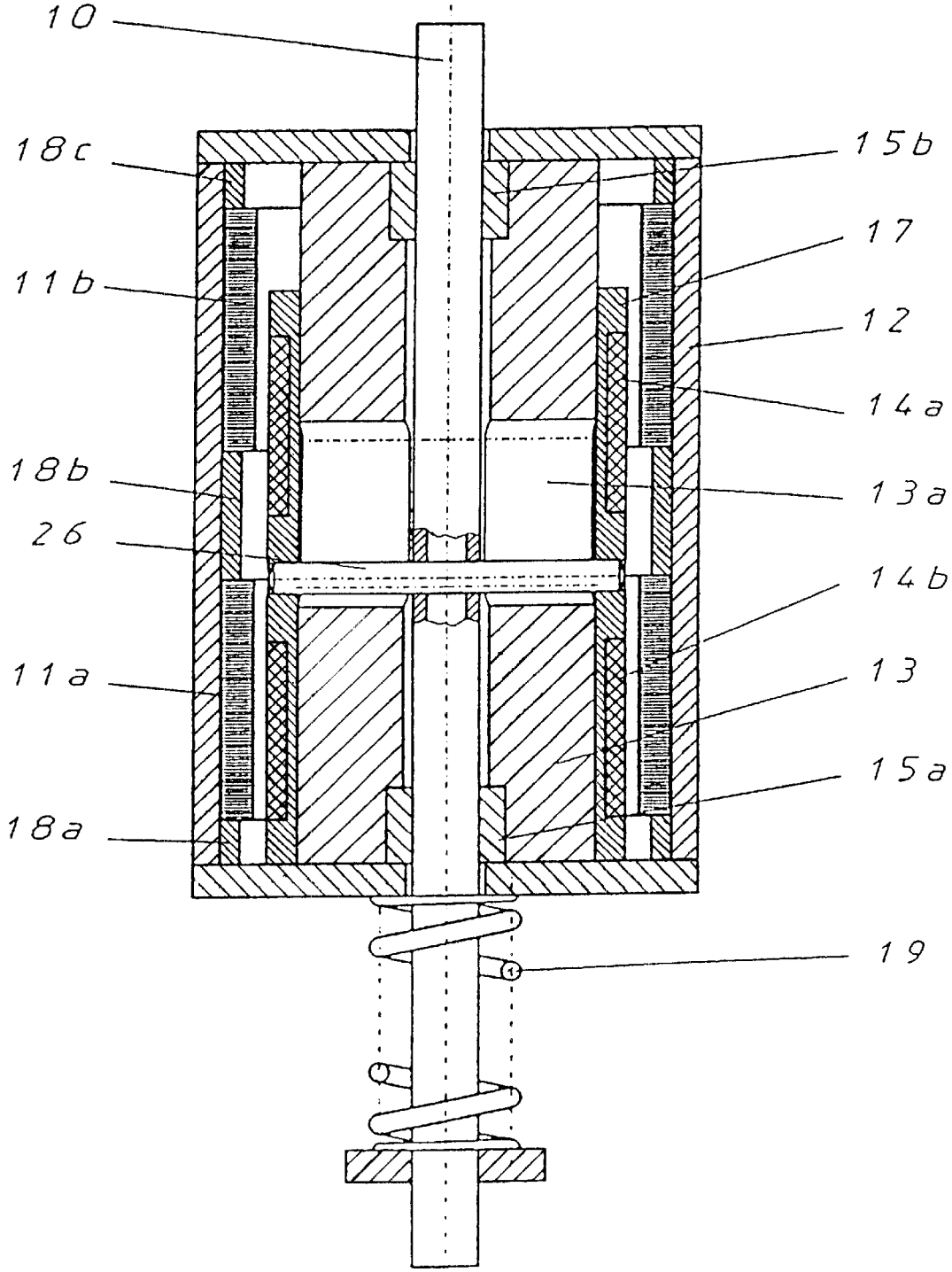
FIG. 5 shows a second embodiment of the linear motor from the actuation device as claimed in the invention in a lengthwise section.
Figure 6:
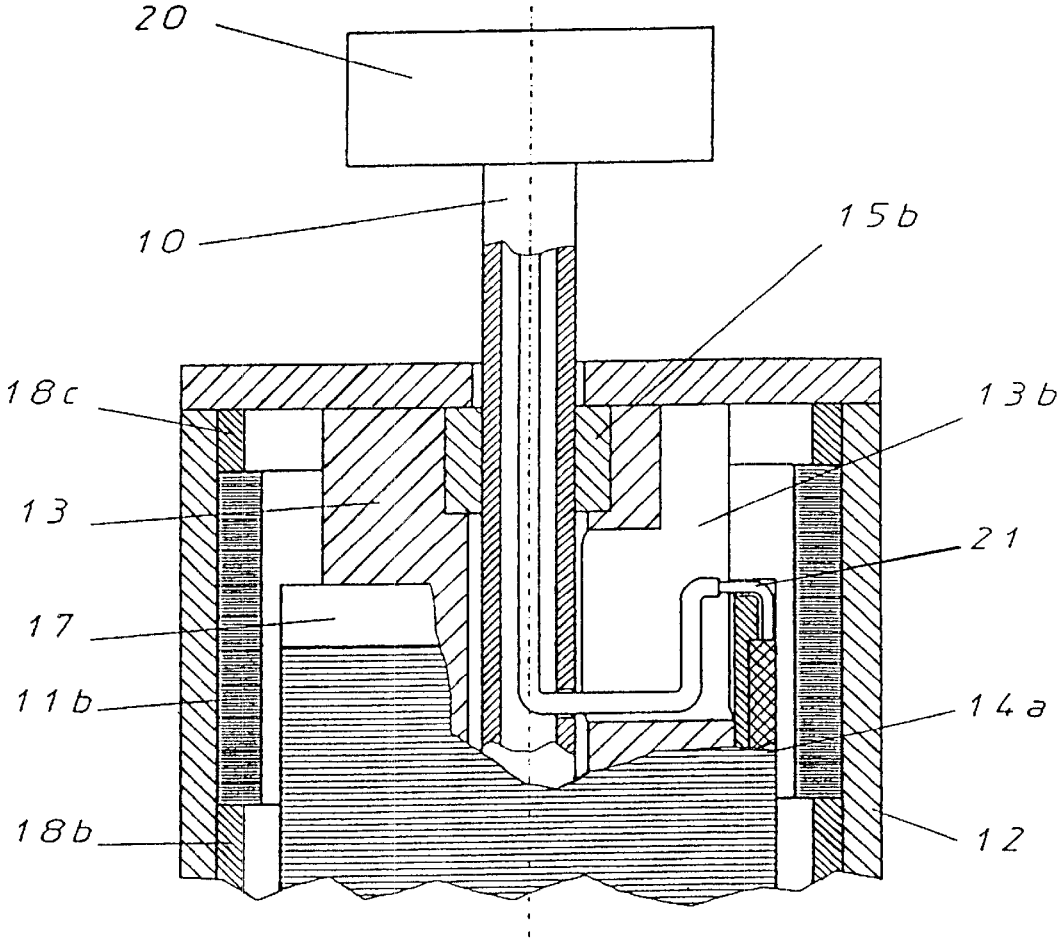
FIG. 6 shows a sectional view of a cable penetration in the linear motor from FIG. 5.

FIG. 6 shows a sectional view of a cable penetration in the linear motor from FIG. 5.

The same reference numbers refer to the identically or similarly made elements or features in FIGS. 1 to 8.

FIG. 1 shows a first embodiment of the actuation device as claimed in the invention.

The actuation device provided for a sewing machine (hereinafter the expression "sewing machine" also includes sewing means, this invention relating both to sewing means and also sewing machines) has a presser means 3 for holding down the sewn material during stitching and material transport. In doing so the linear motor 1 in the de-energized state presses with a force the presser means 3 against the needle plate 4 of the sewing machine and against the feed dog 5 which in the transport phase with its teeth projects above the top of the needle plate 4. The presser means 3 for this purpose has a pressure bar 31 and a presser foot 32, the feed dog 5 in the raised position shown in FIG. 1 striking the bottom of the presser foot 32 (compare also FIG. 2).

Furthermore, the actuation device as the actuating element for the presser means 3 has a linear motor 1 with a drive rod 10 for controlling the presser force which is exerted by the presser means 3 on the sewn material, which rod is connected via an elastic, low-mass coupling element 2 to the presser means 3. In this way the drive rod 10 of the linear motor 1 is decoupled from the presser means 3 so that the masses to be moved are kept low.

This coupling element 2 is a helical spring in the first embodiment of an actuation device which is shown in FIG. 1. In this way, on the one hand the drive rod 10 of the linear motor 1 is decoupled from the presser means 3, on the other hand however the desired direction connection between the drive rod 10 of the linear motor 1 and the presser means 3 is ensured.

In FIG. 1 the drive rod 10 is located over the presser means 3. In this embodiment the force is transmitted from the drive rod 10 of the linear motor 1 to the presser means 3 in a mechanically especially simple and still exact way.

Figure 2:
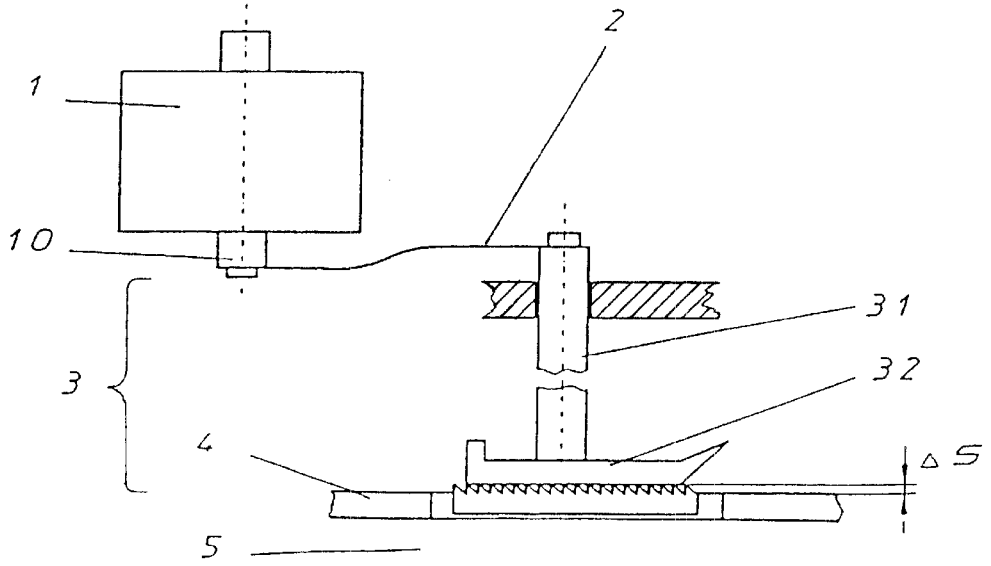
FIG. 2 shows a second embodiment of an actuation device as claimed in the invention.

FIG. 2 shows an embodiment of an actuation device as claimed in the invention.

This second embodiment differs from the first embodiment shown in FIG. 1 essentially in that the coupling element 2 is made in the form of a leaf spring. One such embodiment is especially suited when the drive rod 10, for example for reasons of construction, is located laterally offset to the presser means 3 as shown in FIG. 2.

Figure 3:
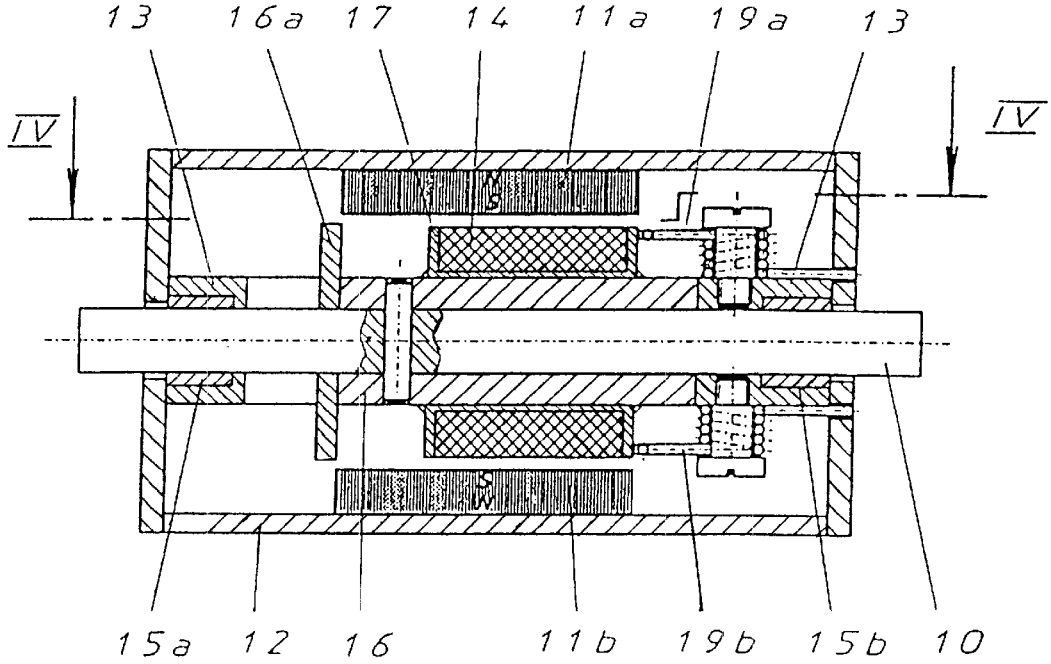
FIG. 3 shows a first embodiment of the linear motor from the actuation device as claimed in the invention in a lengthwise section.
Figure 4:
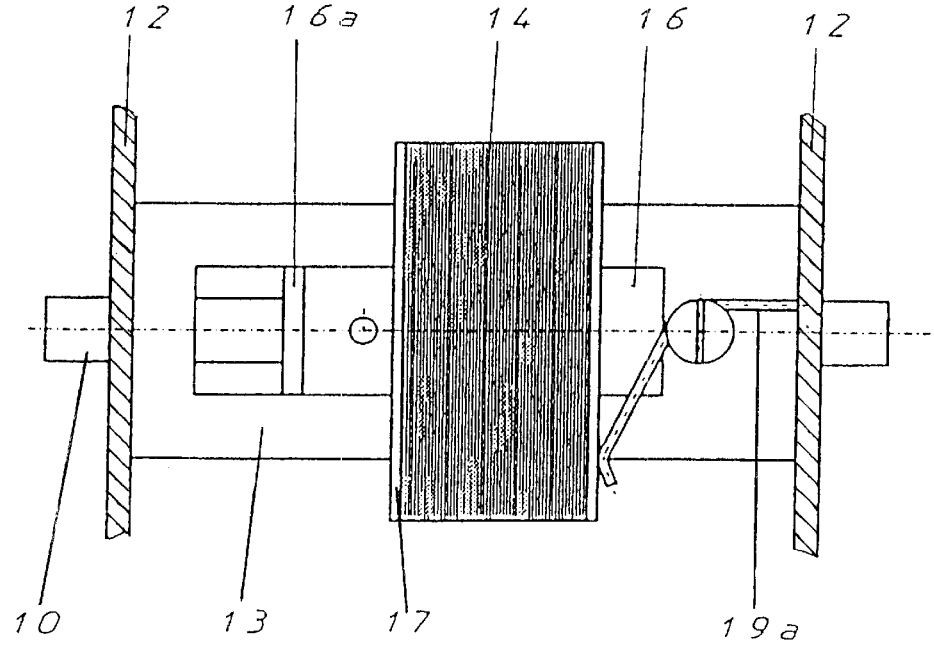
FIG. 4 shows the linear motor from FIG. 3 in an overhead view according to line IV—IV in FIG. 3.

FIG. 3 shows in a lengthwise section a first embodiment of the linear motor 1 which can be assigned to the actuation device from FIG. 1 or to the actuation device from FIG. 2; in FIG. 4 the linear motor from FIG. 3 is shown in an overhead view according to line IV—IV in FIG. 3.

The fact that the linear motor 1 is essentially ironless has the significant advantage that no additional magnetic forces act on the moving parts of the linear motor 1.

The linear motor 1 has two rectangular permanent magnets 11*a*, 11*b*, with which the magnetic field is produced. The material of the permanent magnets 11*a*, 11*b* is based on iron, neodymium, and boron, since with these magnetic materials under economical conditions very high energy densities can be achieved. With these very high energy densities the force necessary for the presser means 3 can be easily produced directly.

The linear motor 1 furthermore has among others a housing 12, a middle piece 13 and an air gap with a coil 14.

Accordingly the magnetic circuit within the linear motor 1 can be closed via the housing 12, via the middle piece 13 and via the air gap with the coil 14.

In the coil 14 a force is produced as soon as electrical current flows through the coil 14. This force is proportional to the current intensity and independent of the location of the coil 14 as long as the coil 14 is located in the homogenous part of the magnetic field; the direction of the force is of course dependent on the direction of the current flow, and the direction and/or the intensity of the current flow in the linear motor I can be controlled by a microprocessor 35 shown in FIG. 1.

As can furthermore be taken from FIG. 3, the drive rod 10 is guided via two bearing bushes 15*a*, 15*b* in the middle piece 13. The middle piece 13 has a central opening 13*a* in which an iron piece 16 which is made as a sliding block is guided and which is advantageously connected to the drive rod 10. In this case the opening 13*a* and the iron piece 16 are made rectangular.

The purpose of this iron piece 16 is to protect the drive rod 10 against torsion, on the one hand; on the other hand the drive force of the coil will be transferred via the iron piece 16 to the drive rod 10. This iron piece 16 is connected to the coil 14 for transmission of the drive force to the drive rod 10 via a coil brace 17.

On the end of the iron piece 16 which is on the left in FIGS. 3 and 4, there is a projecting (compare FIG. 3) part 16*a* which produces a magnetic attraction force, made of ferromagnetic material, here of steel.

FIG. 5 shows in a lengthwise section a second embodiment of the linear motor 1 which can be assigned to the actuation device from FIG. 1 or the actuation device from FIG. 2; FIG. 6 shows a sectional view of the cable penetration in the linear motor from FIG. 5.

To avoid superfluous repetitions, only the embodiments and features are explained below by which the second embodiment of the linear motor 1 illustrated using FIGS. 5 and 6 differs from the first embodiment of the linear motor 1 illustrated using FIGS. 3 and 4.

The second embodiment of the linear motor 1 shown in FIG. 5 has two annular, radially magnetized permanent magnets 11*a*, 11*b* which are spaced apart and with which the magnetic field is produced and with a location in the housing of the linear motor 1 which is dictated by the spacer rings 18*a*, 18*b*, 18*c*.

Here the direction of magnetization of the two permanent magnets differs: When for example in an annular permanent magnet 11*a* for example the inside surface magnetically has the south pole and the outside surface has the north pole, the direction of magnetization for the other annular permanent magnet 11*b* is reversed.

This results in that the magnetic yoke must guide only half of the main field.

As a result of this magnetic arrangement the coil 14 is divided into component coils 14*a* and 14*b* which are wound in opposite directions, the total inductance of the coil 14 due to this type of winding being much less than the inductance of one component coil 14*a*, 14*b* so that the linear motor 1 can be controlled very quickly.

The component coils 14*a*, 14*b* are wound on a coil brace 17 of nonmagnetic material. This coil brace 17 is securely connected to the drive rod 10 using a pin 26. To keep the inertial mass of the linear motor 1 small, the drive rod 10 is made hollow. The coil 14 with the coil brace 17 is the movable part of the linear motor 1, the current supply to the moving coil 14 being achieved as claimed in the invention according to FIG. 6 which shows a cross sectional representation of the cable penetration in the linear motor 1 from FIG. 5.

An electrical, for example two-wire connecting line 21 for the coil 14 is routed to the outside through a recess 13*b* of the middle piece 13 and through the hollow drive rod 10. Since the coil brace 17 is securely connected using a pin 26 to the drive rod 10, when the coil 14 moves no tensile forces act on the electrical connecting line 21. The end of the connecting line 21 is connected to the plug 20 which at the same time contains the strain relief for the opposite plug.

It is common to the first embodiment of the linear motor 1 which is shown in FIGS. 3 and 4 and the second embodiment of the linear motor 1 which is shown in FIGS. 5 and 6 that the drive rod 10 is routed via two bearing bushes 15*a*, 15*b* in the middle piece 13. The middle piece 13 has a central opening 13*a* in which a steel pin 26 is routed which is connected to the drive rod 10. Here the opening 13*a* is made as an elongated hole and the pin 26 is made round. The purpose of this pin 26, like with reference to the iron piece 16 according to the first embodiment of the linear motor 1 which is shown in FIGS. 3 and 4, is to protect the drive rod 10 against torsion, on the one hand; on the other hand, the drive force will be transferred via the pin 26 to the drive rod 10.

These properties and features are convincingly suitable for a presser drive since in this way the presser force can be adjusted depending on the rpm n of the sewing machine. The required pressing force for the presser means 3 is however relatively high so that direct drive as is present for the illustrated embodiment would cause larger dimensions of the linear motor 1.

But in order to ensure a compact design of the linear motor 1, the drive rod 10 using the first embodiment of the linear motor 1 which is shown using FIGS. 3 and 4 is pretensioned by two spring elements 19*a*, 19*b* which are located on both sides of the middle piece 13 in order to reliably prevent the formation of additional torque; in the second embodiment of the linear motor 1 which is illustrated using FIGS. 5 and 6 the drive rod 10 is pretensioned by a spring element 19.

In this case the linear motor 1 in the de-energized state presses the presser means 3 by means of the spring elements 19*a*, 19*b* (compare FIGS. 3 and 4) or by means of the spring element 19 (compare FIG. 5) with a force against the needle plate 4 (compare FIGS. 1 and 2) of the sewing machine which is roughly one third of the maximum force of the presser means 3. At slow sewing speeds sewing takes place with this pressing force of the spring elements 19*a*, 19*b* (compare FIGS. 3 and 4) or of the spring element 19 (compare FIG. 5), and this pressing force can be reduced if necessary by a corresponding current being sent in the negative direction through the linear motor 1.

The current flow through the linear motor 1 in the negative direction can be dimensioned here such that the force of the spring elements 19*a*, 19*b* (compare FIGS. 3 and 4) or of the spring element 19 (compare FIG. 5) is compensated and the presser force moreover disappears. This forceless switching of the presser means 3 is important for sewing technology especially when the seam runs at a right angle. At the corner point of the seam the sewing machine stops in the position in which the needle is at the bottom.

The presser means 3 is then switched without force so that the sewn material can be comfortably turned into the desired direction. This forceless switching of the presser 3 means can take place either program-controlled or pushbutton-controlled.

The known transport mechanism of the sewing machine at a known angular position of the main shaft of the sewing machine with the feed dog 5 presses the presser foot 32 up by a distance As (compare FIGS. 1, 2 and 8), the teeth of the feed dog 5 gripping the sewn material. Then, depending on the adjusted stitch length, linear motion in the transport direction takes place. Then the feed dog 5 is lowered.

If by means of the linear motor 1 there is pressure with a constant force on the presser foot 32, the drive rod 10 of the linear motor 1 at slow rpm n of the sewing machine participates in the motion of the presser foot 32. This means that when the presser foot 32 moves up by the distance As, the drive rod 10 is moved up by the same distance As because the time of the transport phase is long enough. Here the actual stitch length L in the lower rpm range from $n_0$ to $n_1$ of the sewing machine remains constant (compare FIG. 7 which shows a diagram of the size of the actual stitch length L depending on the rpm n of the sewing machine). The motion of the drive rod 10 up and down causes vibrations and noise.

When the rpm n of the sewing machine become higher, the acceleration upward becomes greater and the transport time becomes shorter. This causes the further problem that the spring-mass system formed out of the coupling element 2 and the mass of the drive rod 10 results in that in the middle rpm range from $n_1$ to $n_2$ of the sewing machine (compare FIG. 7) the compression force on the presser foot 32 becomes smaller, and the presser foot 32 under certain circumstances can even rise off the sewn material for a short time; in the middle rpm range from $n_1$ to $n_2$ of the sewing machine the actual stitch length L is reduced by the reduced compression force on the presser foot 32 (compare FIG. 7).

When the rpm n of the sewing machine are increased further, the drive rod 10 of the linear motor 1 can no longer move as a result of its mass inertia, starting at a certain rpm, and the actual stitch length L becomes longer again. This corresponds to the curve behavior in the rpm range from $n_2$ to $n_3$ of the sewing machine (compare FIG. 7).

Figure 7:
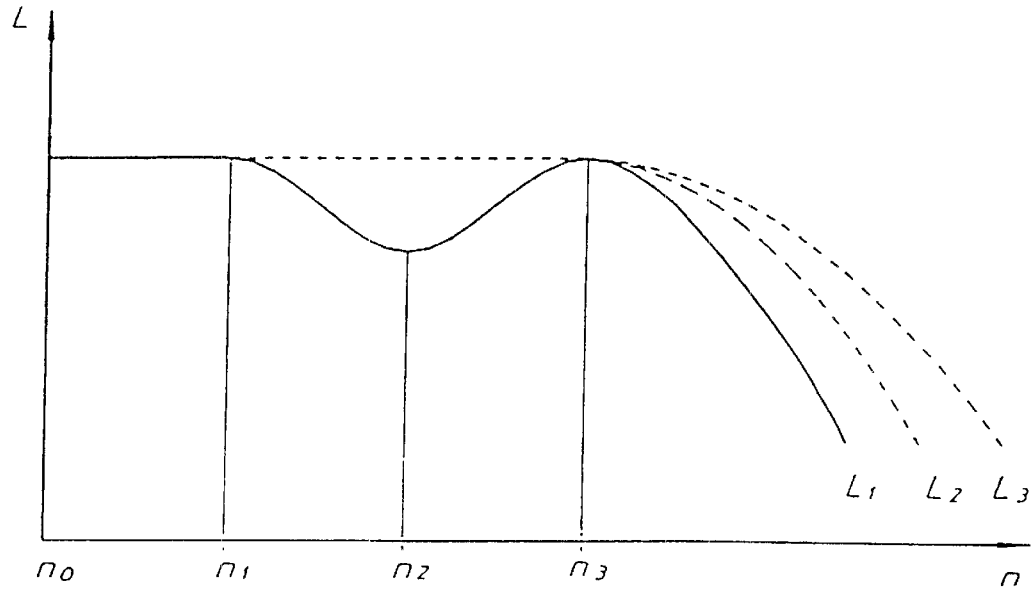
FIG. 7 shows a diagram of the size of the actual stitch length L as a function of the rpm n of the sewing machine.

At even higher speeds $n>n_3$ of the sewing machine the spring-mass system formed from the coupling element 2 and the mass of the presser means 3 appears, with the result that the actual stitch length L again becomes shorter (compare FIG. 7).

In order to prevent vibrations in the lower rpm range $n<n_1$ of the sewing machine and in order to achieve a constant actual stitch length L in the middle rpm range from $n_1$ to $n_3$ of the sewing machine, the force of the linear motor 1 as claimed in the invention is controlled with the angle of the main shaft of the sewing machine such that the linear motor 1 in the transport phase of the feed dog 5 applies a counterforce which is the same as the spring force $F=C\cdot\Delta s$. When the feed dog 5 presses the presser foot 32 by the distance Δs (compare FIGS. 1, 2 and 8) upward, the path change via the coupling element 2 with the spring constant C produces a force acting on the drive rod 10. When the linear motor 1 counteracts this force with the same force, the drive rod 10 remains in its rest position.

The winding of the component coils 14*a*, 14*b* in the opposite directions (compare FIG. 5) ensures a small electrical time constant of the linear motor 1 so that the above described angularly synchronous triggering of the motor force becomes possible. Outside the transport phase the motor current is lowered (compare FIG. 8 which shows a diagram of the motor current I as a function of the angle of rotation 0 of the main shaft of the sewing machine) by which the heating of the component coils 14*a*, 14*b* (compare FIG. 5) is moreover kept small.

In order to prevent a change of the actual stitch length L at high rpm $n>n_3$ of the sewing machine (compare FIG. 7) the pretensioning of the coupling element 2 must be increased. This is achieved by means of a constant force component of the linear motor I by a DC component $I_G$ which can be changed depending on the rpm (compare FIG. 8). This force increases with the speed n of the sewing machine, the dependency of the current change ΔI on the rpm being determined by the structure of the sewing machine; for this reason this functional dependency is determined once and stored.

Up to middle rpm $n<n_3$ of the sewing machine at which the electrical time constant of the linear motor 1 remains negligible, the above described method with the application of a counterforce works rather well; this also follows from FIG. 7:

While $L_1$ shows the curve of the actual stitch length L without control corrections, $L_2$ shows the curve of the actual stitch length L at which the "dent" i.e. the temporary lowering of the actual stitch length L in the middle rpm range from $n_1$ to $n_3$ of the sewing machine, is eliminated by applying the above described counterforce and in which by the DC component IC (compare FIG. 8) the drop of the curve of the actual stitch length L is shifted "to the right", i.e. into a higher rpm range $n>n_3$ of the sewing machine; for curve $L_3$, due to the increased DC portion $I_G$ the drop of the curve of the actual stitch length L compared to the curve $L_2$ is shifted further to the "right", i.e. into a still higher rpm range $n>n_3$ of the sewing machine. At high rpm $n>n_3$ of the sewing machine the electrical time constant of the linear motor 1 makes itself deleteriously noticeable as the current builds up. The time at which the feed dog 5 moves the presser foot 32 up, at these high rpm $n>n_3$ of the sewing machine becomes shorter than the time for the current rise in the linear motor 1.

Figure 8:
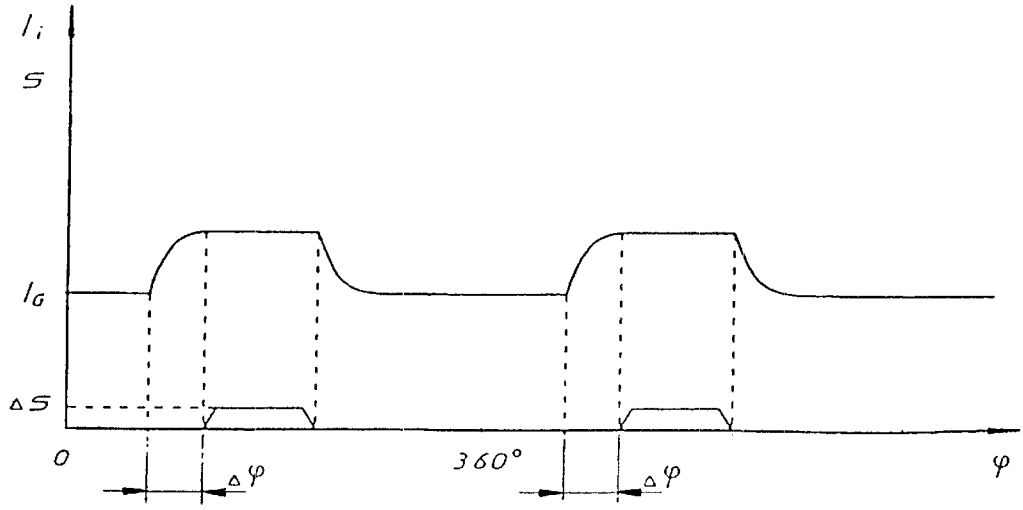
FIG. 8 shows a diagram of the motor current I as a function of the angle of rotation of the main shaft of the sewing machine.

To eliminate the effect of the electrical time constant of the linear motor 1, at high rpm $n>n_3$ of the sewing machine the making angle ϕ of the current is advanced by Δϕ depending on rpm (compare FIG. 8). This ensures that the linear motor 1 at the start of motion of the presser foot 32 can reach the required counterforce.

The above explained possibilities for changing the force of the linear motor 1 as a function of the angular position of the main shaft of the sewing machine or also depending on time can be used to perform the so-called wiper function also with a linear motor-driven presser foot 32. At the start of sewing the free end of the needle thread must lie exposed. Only then can the end of the thread in loop formation be pulled into the sewn material and thus later is no longer visible from above.

To do this, the start of the thread after cutting is conventionally placed by the wiper means in the direction of the operator on the presser foot. If instead the thread end were clamped by the presser foot 32, the amount of thread necessary for loop formation would be withdrawn from the thread storage so that the clamped thread end remains visible.

This fault can be avoided using the linear motor 1 without the need for an expensive wiper means. To do this the presser foot 32 is switched without force in the initial stitch, by the force of the spring elements 19*a*, 19*b* (compare FIGS. 3 and 4) or of the spring element 19 (compare FIG. 5) being compensated with the force of the linear motor 1. If at this point at the start of sewing the end of the needle thread is under the presser foot 32, the end of the needle thread is no longer held by the presser foot 32 and can accordingly be pulled down in the initial stitch formation exactly as if it would lie on the presser foot 32. After the first stitch formation the linear motor 1 is then switched into the normal sewing area.

When the presser means 3 is raised, the linear motor 1 must overcome the pretensioning force of the spring elements 19*a*, 19*b* (compare FIGS. 3 and 4) or of the spring element 19 (compare FIG. 5), by which the drive rod 10 is pretensioned. In the upward motion of the presser means 3 these spring elements 19*a*, 19*b* or this spring element 19 is tensioned such that the pretensioning force becomes greater with the lifting of the presser means 3. When the presser means 3 has reached its upper position and is to be held in this upper position for some time, the linear motor must apply at least a force equivalent to the spring force.

To do this, first with the maximum current the presser means 3 is raised and then the current is lowered so far that the presser means 3 is held in its upper position.

Here in the first embodiment of the linear motor 1 shown in FIGS. 3 and 4 this holding current can be greatly reduced by there being the above described self-holding mechanism at the upper point in the form of a projecting part 16*a* which is made of ferromagnetic material and which produces a magnetic attraction force. When the presser means 3 is lowered, this projecting part 16*a* produces no action. But when the presser means 3 approaches its upper end position, the projecting part 16*a* moves into the action area of the permanent magnets 11*a*, 11*b*. Some of the magnetic field lines then run over the projecting part 16*a* so that an attraction force is formed in the direction of the permanent magnets 11*a*, 11*b*; moreover, the direction of this attraction force is in the opposite direction to the force of the pretensioning by the spring elements 19*a*, 19*b* (compare FIGS. 3 and 4).

The magnitude of the attraction force depends on the mechanical structure. The maximum attraction force occurs when the projecting part 16*a* which produces the magnetic attraction force is in the uppermost position of the presser means 3 on the edge of the homogenous magnetic field. The dimensioning of this unit should be chosen such that the magnetic attraction force and the force of the pretensioning by the spring elements 19*a*, 19*b* (compare FIGS. 3 and 4) almost cancel one another.

If the presser means 3 is to be lowered, the linear motor 1 is supplied with the maximum current such that the drive rod 10 of the linear motor 1 experiences a direction of force downward. In this way the drive rod 10 is accelerated dramatically down under the action of the force of the linear motor 1 and the force of pretensioning by the spring elements 19*a*, 19*b* (compare FIGS. 3 and 4) or of the spring element 19 (compare FIG. 5); this would lead to undesirably strong impact of the presser foot against the needle plate 4 (compare FIGS. 1 and 2).

In order to prevent this impact and associated with it to reduce the noise, shortly before reaching the raised position or shortly before reaching the lowered position there is reversal of the current direction in the linear motor 1, i.e. the current flow of the linear motor 1 can be switched time-controlled shortly before reaching the lower position for a certain time into the opposite direction and thus the presser means 3 is braked. The instant of reversal of the direction of current flow and the duration of the braking phase should be adapted here to the mechanical circumstances.

The essentially identical approach is used in an analogous manner also when the presser means 3 is raised in order to enable soft impact against the raised position.

What is claimed is:

1. Actuating device intended for a sewing means or sewing machine, comprising:

a presser means for holding down sewn material during stitching and material transport, an actuating element for the presser means including at least one linear motor with a drive rod for controlling the presser force which is applied by the presser means to the sewn material, which rod is connected to the presser means, at least one elastic, low-mass coupling element connecting the drive rod to the presser means, wherein the presser means can be moved by the linear motor between a raised position and a lowered position, and means for controlling the linear motor as the rpm (n) of the sewing means or sewing machine increases to apply an additional compressive force to the sewn material by controlling current flow to the linear motor by applying a direct current component $I_G$ which changes depending on time or depending on the angular position of the main shaft of the sewing means or the sewing machine.

2. Actuation device as claimed in claim 1, wherein the linear motor has at least two rectangular or annular permanent magnets.

3. Actuation device as claimed in claim 2, wherein the annular permanent magnets are spaced apart from one another, wherein the magnetization of the one annular permanent magnet is directed against the magnetization of the other annular permanent magnet and wherein the coil is divided into at least two component coils which are wound in opposite directions.

4. Actuation device as claimed in claim 1, wherein the drive rod is pretensioned by at least one spring element.

5. Actuation device as claimed in claim 1, wherein the direction and/or the intensity of the current flow in the linear motor can be controlled by at least one microprocessor.

6. Actuation device as claimed in claim 1, further comprising means for controlling flow direction of the linear motor so that shortly before reaching the raised position or shortly before reaching the lowered position there is one reversal of the flow direction in the linear motor for each.

7. Actuation device as claimed in claim 5, wherein the microprocessor controls the linear motor in a transport phase of a feed dog to apply the additional force which counteracts the force exerted by the feed dog on the drive rod via the coupling element.

8. Actuation device as claimed in claim 5, wherein the microprocessor controls the current flow in the linear motor to increase pretensioning of the coupling element at high rpm (n) of the sewing means or sewing machine.

9. Actuation device as claimed in claim 1, wherein the microprocessor determines and stores the functional dependency of the current flow on the rpm (n) of the sewing means or sewing machine.

10. Actuation device as claimed in claim 5, wherein the microprocessor advances the starting point of the current flow at high rpm (n) of the sewing means or sewing machine by an angular amount ($\Delta\phi$).

11. A sewing means or sewing machine, comprising:

a main shaft;

a presser means holding down sewn material during stitching and material transport, an actuating element for the presser means including at least one linear motor with a drive rod for controlling the presser force which is applied by the presser means to the sewn material, which rod is connected to the presser means, at least one elastic, low-mass coupling element connecting the drive rod to the presser means, wherein the presser means can be moved by the linear motor between a raised position and a lowered position, and means for controlling the linear motor as the rpm (n) of the sewing means or sewing machine increases to apply an additional compressive force to the sewn material by controlling current flow to the linear motor by applying a direct current component $I_G$ which changes depending on time or depending on the angular position of the main shaft of the sewing means or the sewing machine.

12. Actuation device as claimed in claim 11, wherein the linear motor has at least two rectangular or annular permanent magnets.

13. Actuation device as claimed in claim 12, wherein the annular permanent magnets are spaced apart from one another, wherein the magnetization of the one annular permanent magnet is directed against the magnetization of the other annular permanent magnet and wherein the coil is divided into at least two component coils which are wound in opposite directions.

14. Actuation device as claimed in claim 11, wherein the drive rod is pretensioned by at least one spring element.

15. Actuation device as claimed in claim 11, wherein the direction and/or the intensity of the current flow in the linear motor can be controlled by at least one microprocessor.

16. Actuation device as claimed in claim 11, further comprising means for controlling the flow direction of the linear motor so that shortly before reaching the raised position or shortly before reaching the lowered position there is one reversal of the flow direction in the linear motor for each.

17. Actuation device as claimed in claim 15, wherein the microprocessor controls the linear motor in a transport phase of the feed dog to apply a force which counteracts the force acting on the drive rod via a coupling element.

18. Actuation device as claimed in claim 17, wherein the microprocessor controls the current flow in the linear motor to increase pretensioning of the coupling element at high rpm (n) of the sewing means or sewing machine.

19. Actuation device as claimed in claim 11, wherein the microprocessor determines and stores the functional dependency of the current flow on the rpm (n) of the sewing means or sewing machine.

20. Actuation device as claimed in claim 15, wherein the microprocessor advances the starting point of the current flow at high rpm (n) of the sewing means or sewing machine by an angular amount ($\Delta\phi$).

21. A method for operating a sewing means or sewing machine, comprising the steps of:

holding down sewn material during stitching and material transport with a presser means, actuating the presser means with at least one linear motor with a drive rod for controlling the presser force which is applied by the presser means to the sewn material, which drive rod is connected to the presser means by at least one elastic, low-mass coupling element, including moving the presser means by the linear motor between a raised position and a lowered position, and controlling the linear motor with the rpm (n) of the sewing means or sewing machine to apply a direct current component $I_G$ which increases as the rpm(n) increases and to apply an additional force which changes depending on time or depending on the angular position of the main shaft of the sewing means or the sewing machine.

22. The method as claimed in claim 21, wherein the step of controlling the linear motor includes controlling the linear motor in a transport phase of a feed dog to apply the additional force which counteracts the force exerted by the feed dog on the drive rod via the coupling element.

23. The method as claimed in claim 21, further comprising controlling a flow direction of the linear motor so that shortly before reaching the raised position or shortly before reaching the lowered position there is one reversal of the flow direction in the linear motor for each.

24. The method as claimed in claim 21, further comprising controlling the current flow in the linear motor to increase pretensioning of the coupling element at high rpm (n) of the sewing means or sewing machine.

25. The method as claimed in claim 21, further comprising determining and storing the functional dependency of the current flow on the rpm (n) of the sewing means or sewing machine.

26. The method as claimed in claim 21, further comprising advancing the starting point of the current flow at high rpm (n) of the sewing means or sewing machine by an angular amount ($\Delta\phi$).

* * * * *